US010568417B2

(12) United States Patent
DeGroot

(10) Patent No.: US 10,568,417 B2
(45) Date of Patent: Feb. 25, 2020

(54) TELESCOPIC LEG AND METHOD OF ASSEMBLY

(71) Applicant: Rapid-Line Inc., Grand Rapids, MI (US)

(72) Inventor: Daniel DeGroot, Byron Center, MI (US)

(73) Assignee: RAPID-LINE, INC., Grand Rapids, MI (US)

( * ) Notice: Subject to any disclaimer, the term of this patent is extended or adjusted under 35 U.S.C. 154(b) by 0 days.

(21) Appl. No.: 15/957,743

(22) Filed: Apr. 19, 2018

(65) Prior Publication Data

US 2018/0303233 A1 Oct. 25, 2018

Related U.S. Application Data

(60) Provisional application No. 62/487,432, filed on Apr. 19, 2017.

(51) Int. Cl.
*F16M 13/00* (2006.01)
*A47B 9/20* (2006.01)

(52) U.S. Cl.
CPC ..... *A47B 9/20* (2013.01); *A47B 2200/0054* (2013.01); *A47B 2220/0027* (2013.01)

(58) Field of Classification Search
CPC ..... B62J 2001/085; B62J 1/00; B62J 1/06; B62K 19/36
USPC ..... 248/157, 161, 188.2, 188.5, 420, 421, 248/423
See application file for complete search history.

(56) References Cited

U.S. PATENT DOCUMENTS 7,673,936 B2 * 3/2010 Hsu ..... B62J 1/08 297/215.13
8,177,251 B2 * 5/2012 Shirai ..... B62J 1/08 280/288.4
D710,563 S * 8/2014 Panzer ..... D25/126
2004/0178306 A1 * 9/2004 Hallberg ..... F16M 11/046 248/188.5
2010/0187379 A1 * 7/2010 Kragh ..... A47B 9/12 248/188.4
2010/0252697 A1 * 10/2010 Koenig ..... B66C 23/701 248/161

* cited by examiner

*Primary Examiner* — Steven M Marsh
(74) *Attorney, Agent, or Firm* — Craig A. Phillips; Dickinson Wright PLLC

(57) ABSTRACT

A telescopic leg and method of assembly for the telescopic leg, which is generally configured to raise and lower a work surface while supporting it. The telescopic leg includes at least two segments, one of which includes a visible cap through which one of the segments is inserted to trim an opening that matches the profile of the segment doing the trimming and can create an interference fit.

14 Claims, 8 Drawing Sheets

TELESCOPIC LEG AND METHOD OF ASSEMBLY

CROSS REFRENCE TO RELATED APPLICATIONS

This application claims the benefit of U.S. Provisional Application Ser. No. 62/487,432, filed Apr. 19, 2017, which is incorporated herein by reference in its entirety.

BACKGROUND OF THE INVENTION

Field of the Invention

A telescopic leg and method of assembly for the telescopic leg, which is generally configured to raise and lower a work surface while supporting it.

Description of the Prior Art

Apparatuses and methods of the type to which the subject invention pertains are used for assembling telescopic legs that are capable of raising and lowering a work surface, while supporting it. However, such telescopic legs often suffer particular drawbacks, such as becoming increasing unstable as they are extended, particularly at full extension. If an extendible or telescopic leg is unstable, it typically will allow a rocking or instability of the desk, increasing the potential for deformity over time which, in turn, causes increasing the amount of rocking or instable surfaces and failure over time, particularly at full extension, and the cycle repeats typically until the leg is unsuitable for use or has a catastrophic failure. The above problems many times cause the leg's ability to support weight or resist sideways force to be substantially reduced. As such, many telescopic legs fail over time or have very low weight limits.

In addition, traditional methods of manufacture and assembly of telescoping legs have issues if any part has a tolerance deviation from the specifications. Tolerance deviations may create gaps which in turn cause rocking or unstable legs. Even if each part of a leg is within specifications, if the inner leg is on the small side of the allowed tolerance variation and the outer leg is on the larger side of the allowed tolerance variations, when assembled, the combination of tolerance variations may allow the assembled leg to have movement due to the spacing between the legs and typically create an unstable desk. If the opposite tolerance variations exist, the legs may bind or move with difficulty as they extend and contract. Both of the above conditions are very undesirable as desks and tables must be stable and resistant to any movement when forces are applied from use. In view of the above cited issues, legs currently used must be subject to expensive and increased costs due to required tolerances on the parts as well as additional steps of prefitting to avoid the above issues. Some legs during assembly even require cutting a bearing cap or sleeve in accordance to interior or exterior leg segments that were measured. All of this is time-consuming and expensive. Even if special bearing cups, sleeves, or caps are used, precision cutting is often required and it is difficult to get a perfect contour edge for a bearing cap or sleeve, making the exact profile of the opposing part and accounting for any tolerance deviations from the master part profile. As stated above, when a bearing cap or sleeve does not have a tolerance fit, which is often the problem, the supported work surface becomes unstable. While standing desks have recently proliferated many of these are unstable or use heavy and expensive additional cross members to provide additional bracing.

SUMMARY OF THE INVENTION

The present invention is directed to a telescopic leg having a first segment with an outer wall and an inner wall, each of which extend along an axis between a first end and a second end. The inner wall defines a first segment cavity and includes screw bosses or elongated cavities with a slot, and at least one extruded rib, which may include a notch.

The second segment includes an outer wall and an inner wall both extending between a first end and a second end along the axis, and wherein a portion of the second segment is disposed in the first segment cavity when assembled. The inner wall includes at least one screw boss or elongated cavity and at least one extruded rib.

A visible cap is coupled to one of the first and second ends of the first segment, the visible cap having an inner edge defining an opening through which the second segment extends. The opening before assembly is smaller than the second end and during assembly the second end trims or cuts the visible end opening to match the size and profile of the second end of the next most inner segment from the segment to which the visible end is attached to eliminate or reduce tolerance issues during assembly and surprisingly provide a more stable table leg from rocking. The the visible cap includes flanges extending between the inner wall of the first segment and the inner wall of the second segment and wherein the flanges are in fixed engagement with the first segment and sliding engagement with the second segment.

A hidden cap coupled to one of the first and second ends of the second segment, and wherein the hidden cap is disposed within the first segment cavity and includes tabs extending between the outer wall of the second segment and the inner wall of the first segment and wherein the tabs are in fixed engagement with the second segment and in sliding relationship with the first segment. The tabs in combination with the flanges on the visible caps create a solid table or extendable leg that is substantially free from rocking and the insertion of the second end of the next most inner segment may cut the profile of the flanges that engage the outer surface of the next most inner section.

The telescopic leg has the first segment shaped as a polygon having at least three sides and at least three corners. It is illustrated in the figures and believed to be most commonly to have four sides, however the number of sides may vary, but as the sides increase, beyond four, the expense of producing increases generally without much additional benefit, or as the sides increase past six, limiting some of the internal configurations that the present invention uses to provide its unique benefits. The inner wall of the first segment at the corners of the first segment includes at least three corners, such as a four sided configuration could have four corners. It should be noted that the leg may have an opening along one of the sides, but generally speaking it is expected that a three sided square oar rectangle shape would still have four corners that could be engaged by the visible cap, although the flanges on the hidden cap may need to engage the corners. The at least three corners include elongated cavities or screw bosses extruded, each having a slot extending along their length. The visible cap includes engagement projections in an interference fit with the cavity and wherein the flanges extend inwardly from the engagement projections, through the slot.

The telescopic leg, specifically the second or intermediate segment may include includes inset corners and wherein the flanges on the visible cap coupled to the first segment extend to and engage the inset corners on the outer surface of the second segment.

The telescopic leg of may include a third or inner segment fitting within the second or intermediate segment, and wherein the second segment includes a second visible cap coupled to the second segment and wherein the third segment includes a second hidden cap coupled thereto. Due to the differences between the location of the screw bosses, size and profile of the second segment versus the first segment, the location of the engagement projections and flanges are expected to be different.

The telescopic leg, specifically the third segment includes at least three sides with profiled corners between each side and wherein second visible cap includes flanges extending from and in sliding engagement with the profiled corners.

The telescopic leg, specifically the first segment includes at least three corners, the second segment includes at least three inset corners, and the third segment includes at least three profiled corners, and wherein the cross section profile of the corners is different from the cross section profile of the inset corners and the profiled corners.

The cross sectional profile of the inset corners is different from the cross section profile of the profiled corners, and even the location may be slightly offset from the true corner. The first visible cap has flanges with a first cross sectional profile and the second visible cap has a second cross section profile and wherein the first and second cross sectional profiles do not match.

The visible cap further includes at least one clip and is coupled to the first segment has at least three sides, and wherein at least one of the at least three sides on the first segment has an extruded rib on the inner wall, and wherein the inner rib includes a notch and wherein the visible cap is coupled to the first segment with the clip fitting within the notch. The the clip has a cross leg fitting within the notch and wherein the clip is recessed relative to the surface of the extruded rib when located in the notch.

The hidden cap includes tabs extending between the first and second segment, and wherein the tabs are in sliding engagement with the first segment.

A method of assembling a telescopic leg having a first, second and third segments and wherein the first and second segments each include an inner surface having an extruded rib with a notch, and a first and second end, a first and second visible cap, each having engagement projections with flanges, clips and an opening with an inner edge, and a first and second hidden cap, each having flanges, the method including the following steps.

Assembling a first visible cap to the first end of the first segment by inserting the first visible cap into an opening on the first end of the first segment until the clip on the first segment is located at least partially in the notch, and inserting the second visible cap into an opening on the first end of the second segment.

Inserting the second end of the second segment through the visible cap into the opening on t the visible cap on the first segment and wherein the opening on the visible cap is smaller than the second end of the second segment, and wherein during the step of inserting, the second end cuts a bigger opening on the first visible cap on the first segment.

Inserting the second end of the third segment through the second visible cap into the opening on the second visible cap on the second segment and wherein the opening on the second visible cap is smaller than the second end of the third segment, and wherein during the step of inserting, the second end cuts a bigger opening on the second visible cap on the second segment.

Assembling the hidden caps to the second ends of the second and third segments, after the steps of inserting.

The shape of the opening on each of the visible caps does not match the shape of the second ends of the second and third segments until after the steps of inserting are completed, as the step of inserting cuts or trims the opening to match the profile of the segment that was inserted in through the visible cap. In addition, just cutting the end of the segments generally leaves a sharp enough edge to trim the plastic material of the visible caps. It should be noted that the hidden caps when inserted could also be trimmed during insertion before they are screwed or otherwise coupled to the end opposing the ends having or proximate the visible caps.

DETAILED DESCRIPTION OF THE INVENTION

Figure 1:
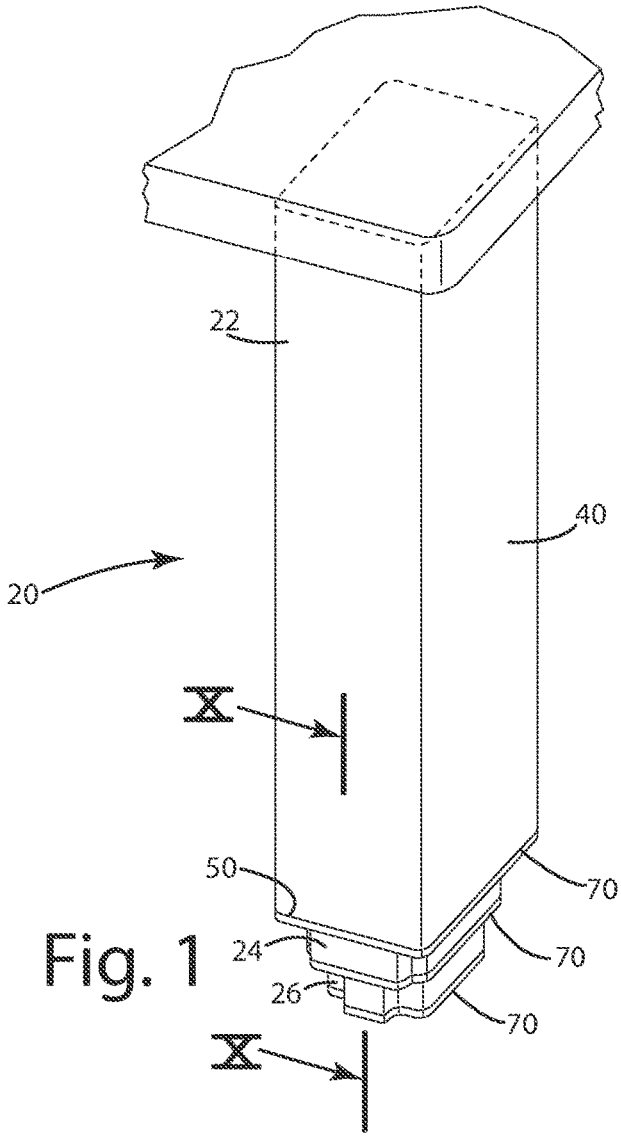
FIG. 1 is a perspective view of a telescopic leg, attached to a workstation, in a retracted position.

Referring to the Figures, wherein like numerals indicate corresponding parts throughout the several views, a telescopic leg 20 and method of assembly constructed in accordance with the subject invention is shown in the Figures.

The telescopic 20 leg assembly is used for raising and lowering a work surface while supporting it. The telescopic 20 leg includes a plurality of segments, the number of which may vary, depending on the desired height. In the illustrated figures, the telescopic leg includes an outer segment 22, an intermediate segment 24, and an inner segment 26. Each of the segments (22, 24, 26) include an inner surface or wall 30 that defines a cavity 32 and an outer wall 40 that extends along an axis A between a first end 42 and a second end 44. The inner segment 26 is disposed into the cavity 32 of the intermediate segment 24 and the intermediate segment 24 is disposed in the cavity 32 of the outer segment 22, thereby allowing the segments (22, 24, 26) to slide telescopically along the axis A relative to one another. As stated above, the telescopic leg 20 may be formed without the intermediate segment 24 and with multiple intermediate sections.

Figure 3:
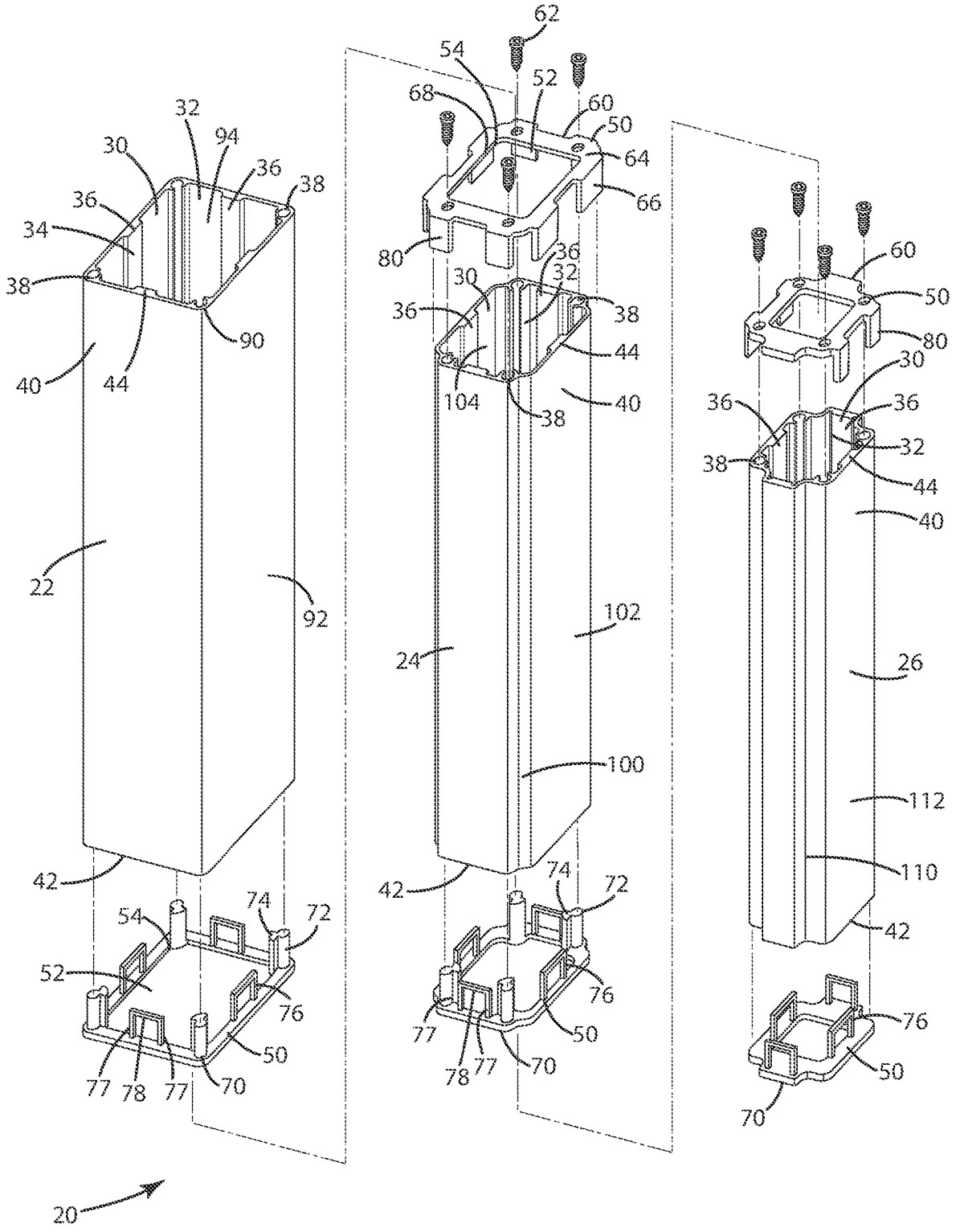
FIG. 3 is an exploded perspective view of the telescopic leg in FIG. 1.
Figure 4:
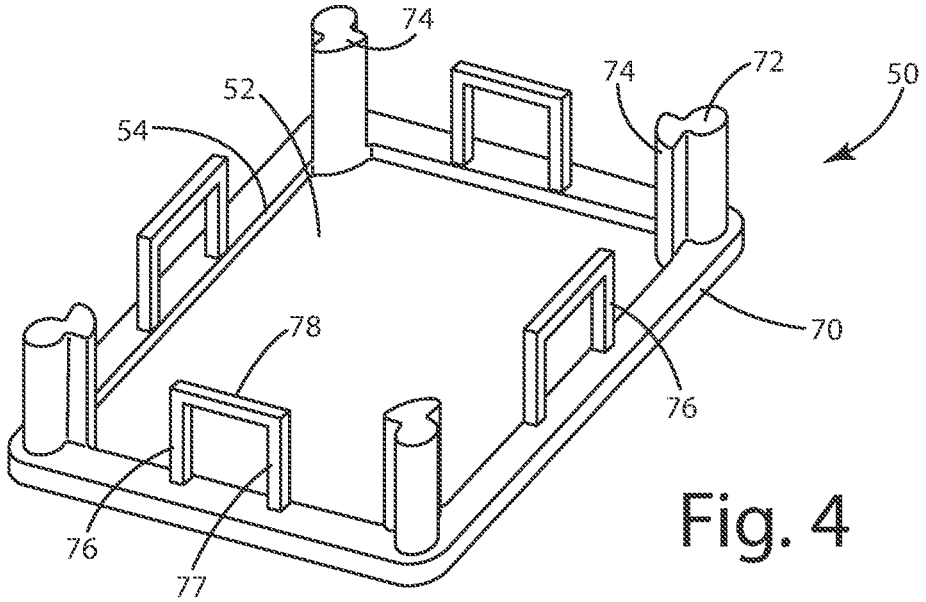
FIG. 4 is a perspective view of an outer cap.
Figure 5:
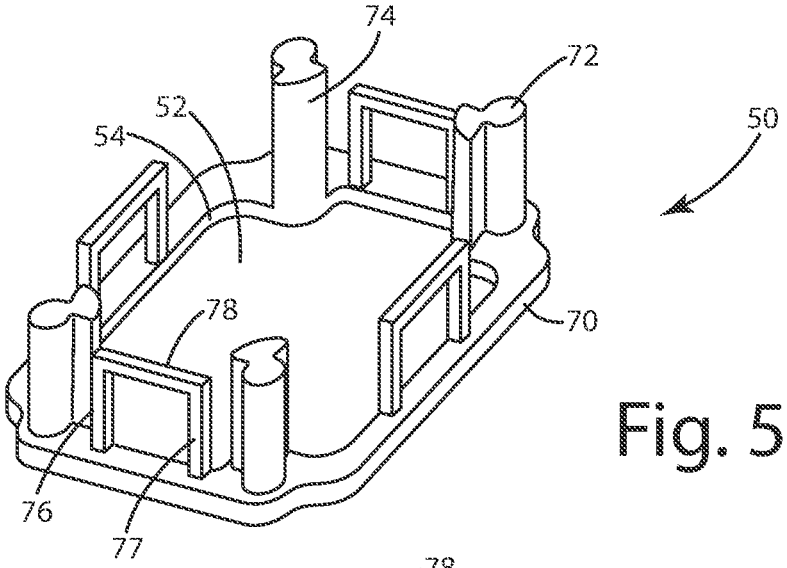
FIG. 5 is a perspective view of an intermediate cap.
Figure 6:
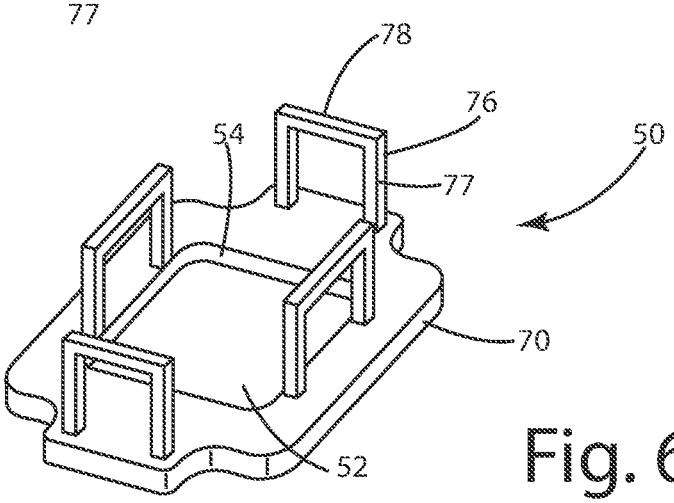
FIG. 6 is a perspective view of the inner cap.
Figure 7:
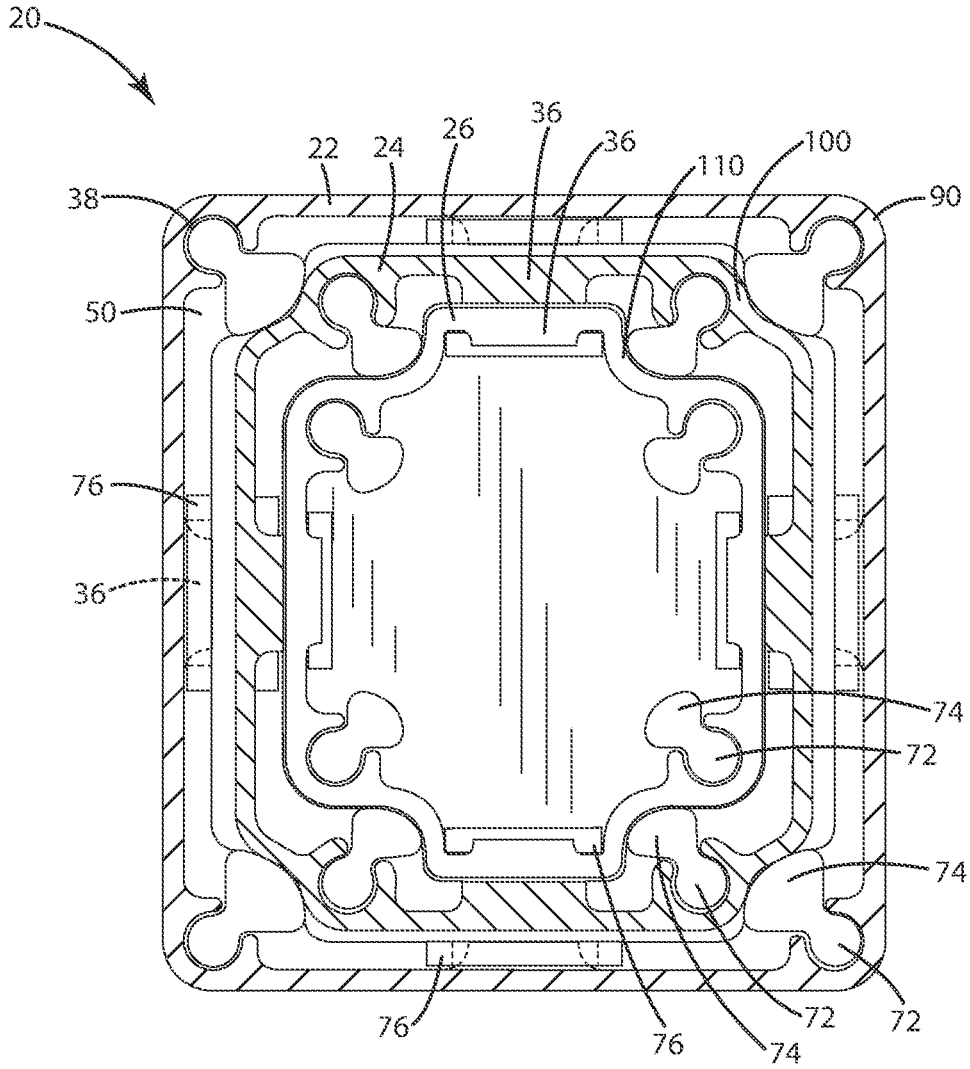
FIG. 7 is a cross sectional view of the telescopic leg in FIG. 1 along lines VII-VII illustrating the inner, intermediate and outer legs.
Figure 8:
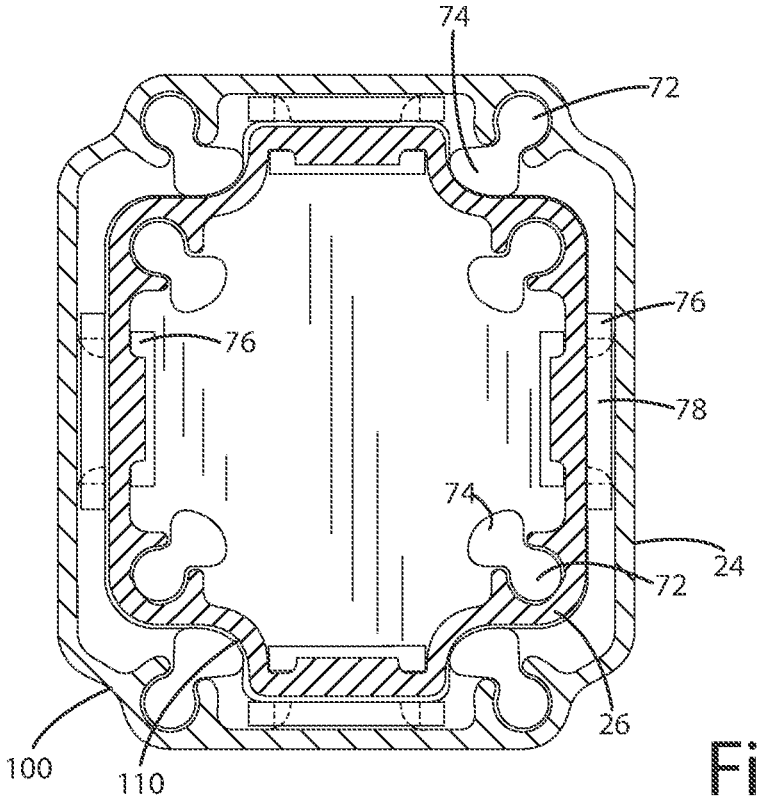
FIG. 8 is a cross sectional view of the telescopic leg in FIG. 2 along lines VIII-VIII illustrating the intermediate and inner legs.
Figure 9:
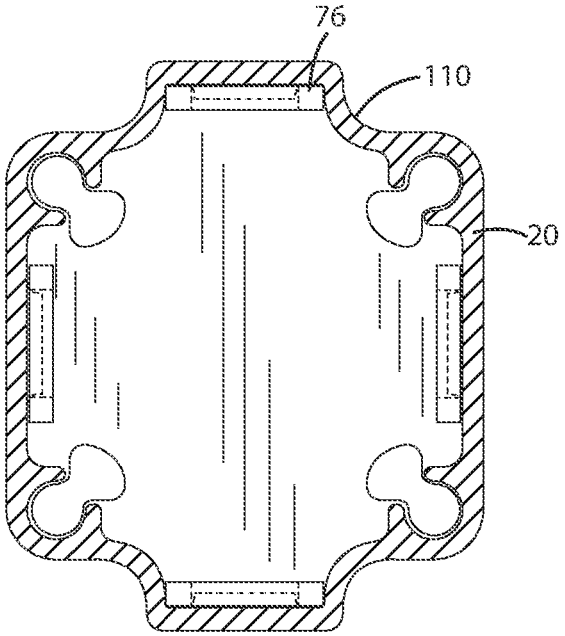
FIG. 9 is a cross sectional view of the telescopic leg in FIG. 2 along lines IX-IX illustrating the inner leg.
Figure 10:
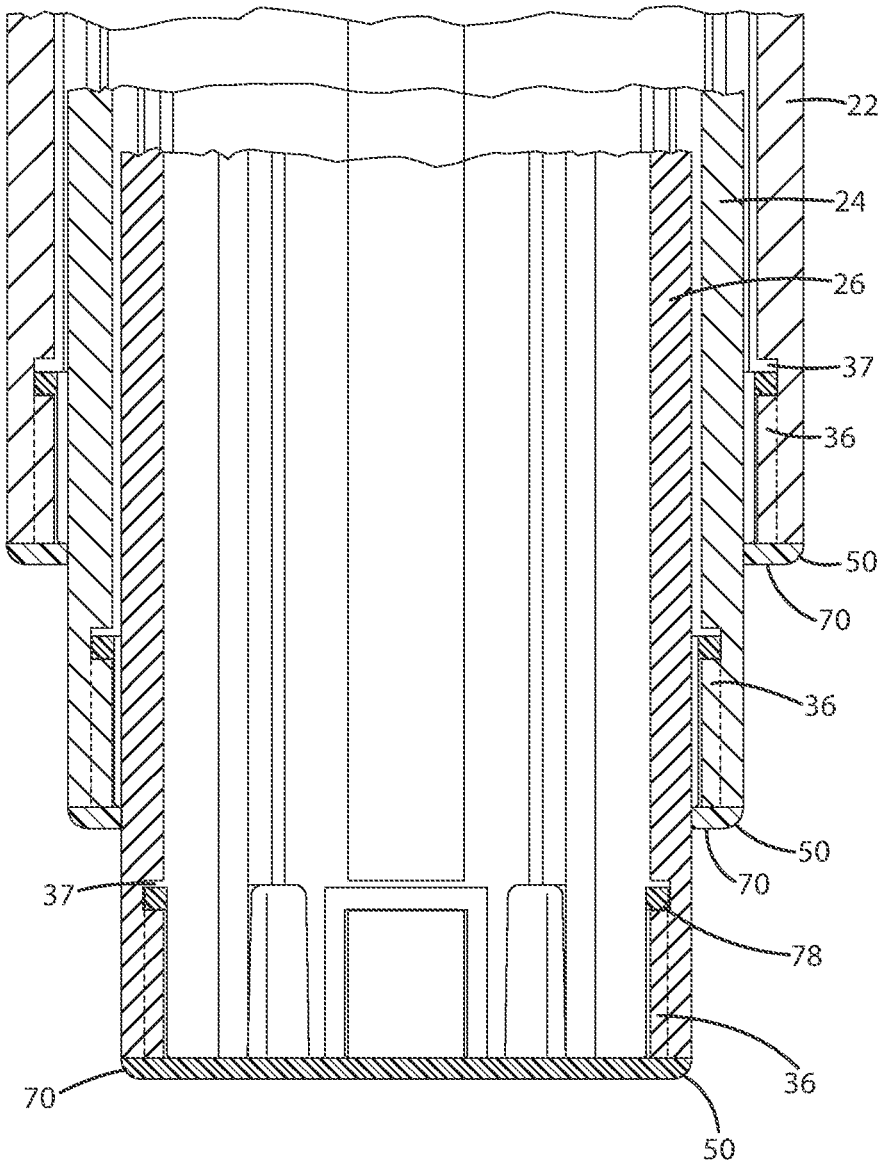
FIG. 10 is a cross sectional view of the telescopic leg in FIG. 1 along lines X-X.
Figure 11:
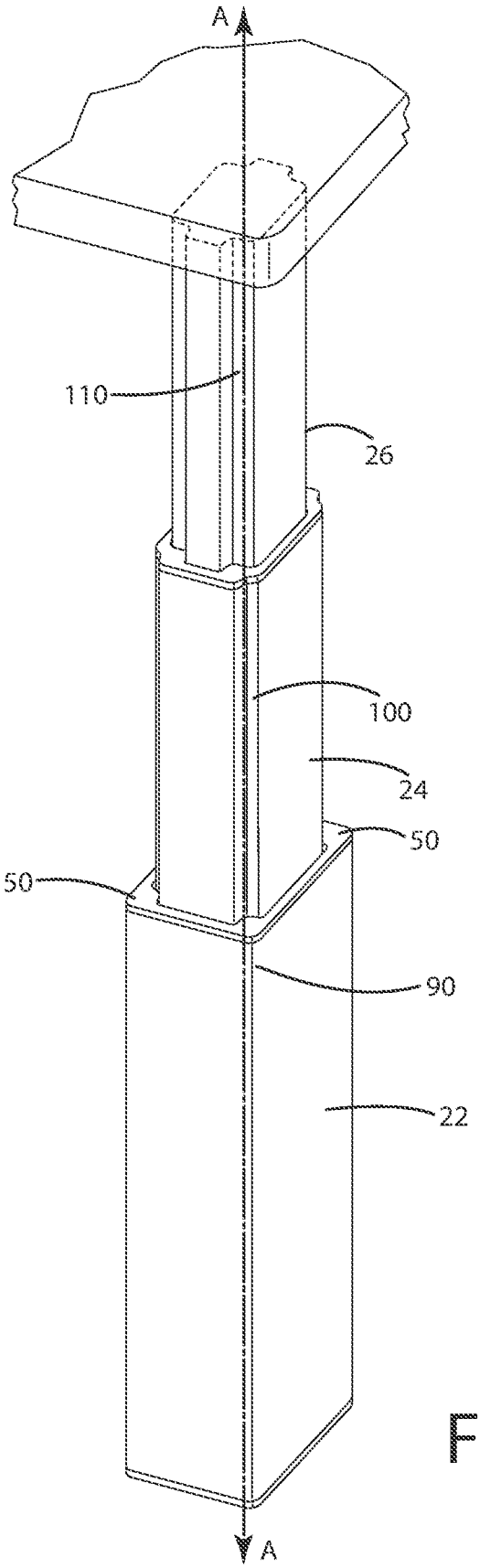
FIG. 11 is a perspective view of the telescopic leg in FIG. 2 in a reverse orientation.
Figure 12:
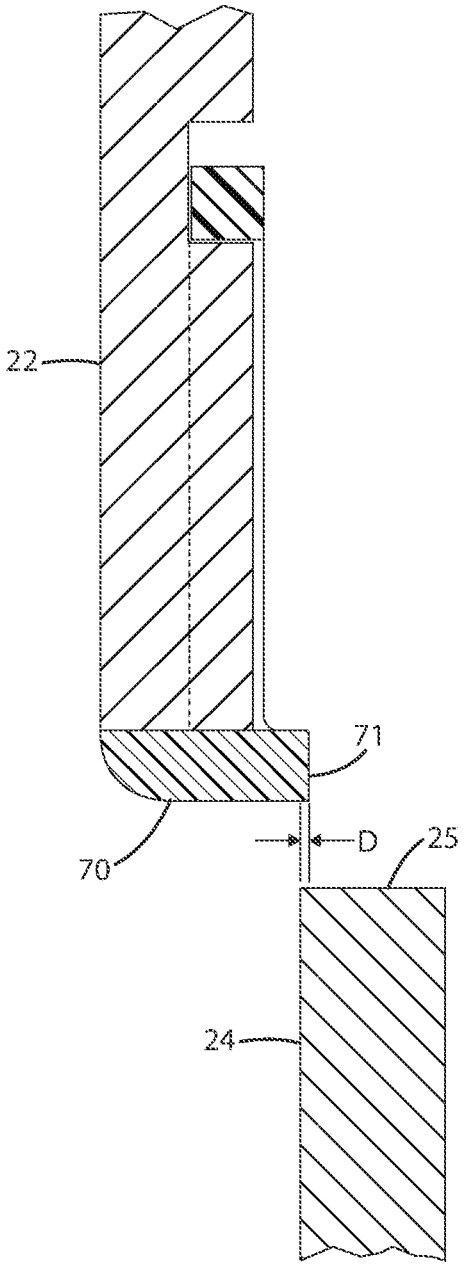
FIG. 12 is a cross sectional view of the telescopic leg in FIG. 2 taken along lines XII-XII.
Figure 13:
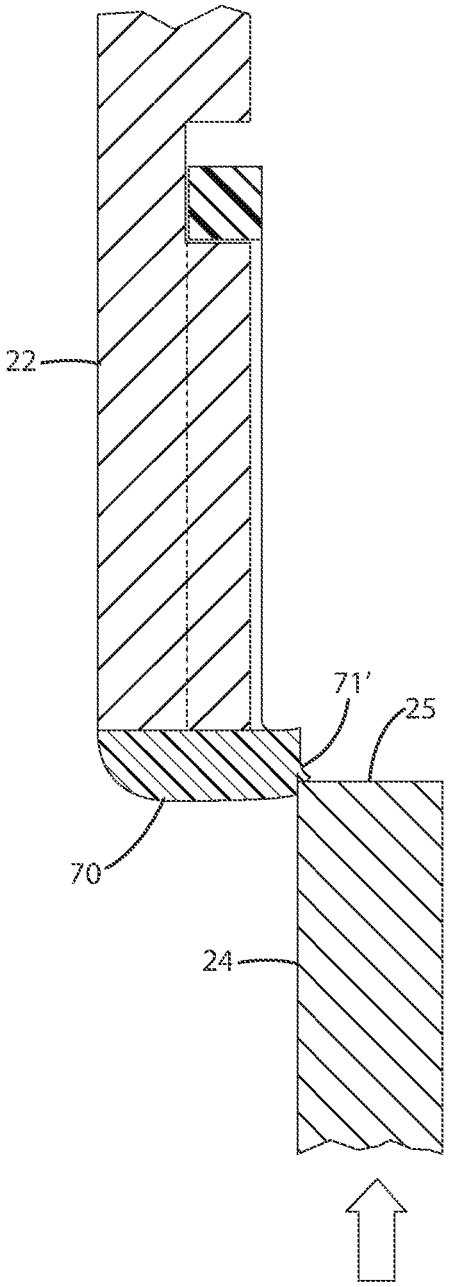
FIG. 13 is a cross-sectional view of the telescopic leg in FIG. 2 taken along lines XII-XII, taken during the act of trimming during assemble to create an interference fit.

The telescopic legs 20 may be formed with a variety of surface configurations. The segments (22, 24, 26) of the telescopic leg 20 in the Figures are exemplary illustrated in FIGS. 3 and 7-9, each of the ends (42, 44) of the outer segment 22 have a rectangular shape and include four edges defining four rounded corners 90 and the outer exterior surfaces 92 extending therebetween as defined by the outer wall 40 of the base segment 22. The surface configuration of the outer exterior surfaces 92 may vary and have different profiles depending on the desired design aspects. For ease of manufacture and clean aesthetics, the outer segment 22 is illustrated with substantially flat outer exterior surfaces 92. As discussed in more detail below, the outer segment 22 further includes outer inner surfaces 94 as defined by the inner wall 30 of the base segment 22. The intermediate segment 24 is disposed adjacently and interiorly to the outer segment 22. The outer wall 40 of the intermediate segment 24 is spaced from the inner wall 30 of the base segment 22 so that in operation the two walls never touch. As illustrated in the figures, although not required, for ease of assembly and cost, the inner wall 30 of the base segment, specifically the outer inner surface 94, matches the surface configuration of the outer wall 40 of the intermediate segment 24, specifically of an intermediate exterior surface 102 extending between inset corners 100 on the intermediate section 24. As one skilled in the art would recognize, while the telescopic leg 20 as illustrated has four sides forming a polygon, such as a square or rectangle, it as easily could be made with three, five, six, or more sides. Therefore, while the description herein generally discusses four corners and four sides, and the like, the leg may have more or less depending on the desired shape or configuration. Also as best illustrated in FIGS. 3 and 7-9, each of the ends (42, 44) of the intermediate segment 24 includes four edges defining the four rounded inset corners 100. As seen in FIGS. 3 and 7, the corners 100 are profiled to fit the spring required to secure a cap 50 to the outer segment 22. The inner segment 26 is disposed adjacently and internally to the intermediate segment 24. As discussed above, another segment could be added between the intermediate section 24 and the inner segment 26. Of course, more than one segment could be added. The outer wall 40 of the inner segment 26 is spaced from the inner wall 30 of the intermediate segment 24 so that in normal operation the two walls never touch. More specifically, the inner surface 30 of the intermediate segment 24 has an intermediate inner surface 104 configured to oppose but not engage the outer wall 40 of the inner segment 26, specifically an inner exterior surface 112 extending between the profiled corners 110.

The inner wall 30 of the segments (22, 24, 26) each define a plurality of screw bosses 38 spaced about the axis A that extend into the cavity 32 between the ends (42, 44). The screw bosses 38 may include an internal threading. However, in the illustrated embodiment, the screw bosses 38 do not have internal threading but instead use self tapping screws to attach some of the caps 50 as illustrated in FIG. 3. In the illustrated embodiment, there are four screw bosses 38 in each segment (22, 24, 26). The screw bosses 38 of each of the segments (22, 24, 26) are disposed in an offset relationship to the screw bosses 38 on each of the adjacent segments (22, 24, 26). A plurality of extruded ribs 36 are spaced symmetrically about the axis A between the screw bosses 38 and extend from the inner wall 28 into the cavity between ends (42, 44). The extruded ribs 36 may be included for structural support but also are used to secure the caps 50 which are not screwed to the screw bosses 38. In addition, the extruded ribs are added to allow screw holes to be drilled and tapped into the extruded ribs 36 for attachment to a work surface base, support stand, or the like.

Figure 2:
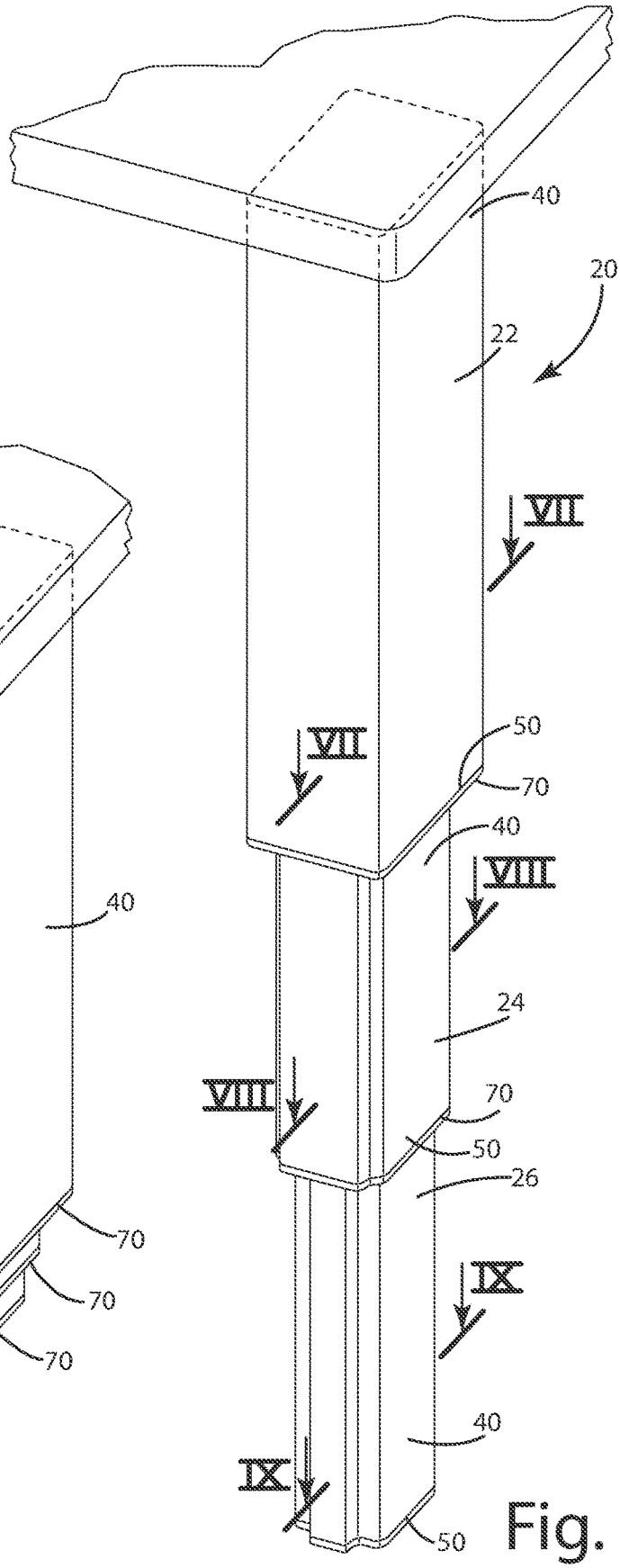
FIG. 2 is a perspective view of the telescopic leg in FIG. 1 in an extended position

The cap 50 is attached to at least one of the ends 42, 44 of the segments (22, 24, 26) for bearing a non axial load relative to the axis between the segments (22, 24, 26). As illustrated in FIG. 2, some segments, such as the illustrated segments (24, 26), included a cap 50 at each end (42, 44). The caps 50 are attached to adjacent segment (22, 24, 26) to allow the segments (22, 24, 26) to slide relative to one another as the telescopic leg 20 extends and contracts. The visible or second caps 70 are configured to create an interference fit with the inside adjacent segment (24, 26), which supports and resists movement from off axial loads. More specifically, as further discussed below, during the assembly process, the inside adjacent segment is forced through the opening 52 on the cap 50. The inner edge 54 that defines the opening 52 and the inner edge 54 is trimmed by the end (42, 44) of the inside adjacent segment (24, 26). The caps 50 define a face portion for abutting against an end 42, 44 of the attached segment (22, 24, 26). The face portion has an interior or inner edge 54 extending along, or extending to, a cross-sectional contour of the outer wall 40 of the segment (24, 26) disposed adjacently and internally. In addition, the face portion has an exterior edge extending along, or extending to, a cross-sectional contour of the outer wall 28 of the segment (22, 24, 26) to which it is attached.

The caps 50, specifically the visible caps 70, further define a plurality of engagement projections 72 superimposed over the screw bosses or elongated cavities 38, and inserted into the screw bosses 38 when assembled. The elongated cavities 38 include a slot. Furthermore, the caps 50 also define a plurality of flanges 74 extending from the engagement projections 72. The engagement projecting 72 are configured to also extend along the outer wall 40 of the attached segment (22, 24, 26) and are in frictional engagement with the outer wall 40 of the segment (24, 26) disposed adjacently and interiorly. The flanges 74 are semi-circular and have a profile matching the inset corners 100 or profiled corners 110. More specifically, the engagement projections 72 are spaced along said cap 50 to slide along said rounded inset corners 100 of said intermediate segments 24 and the profile corners 110 of the inner segment 26. As detailed above and below, the inner edge 54 of the engagement projections 72 are also trimmed during assembly, creating the interference fit to avoid any rocking or off axial movement, as the engagement projections 72 engage the outer wall 40 of the intermediate or inner segment 24, 26 from multiple sides.

A cap 50, specifically a first or hidden cap 60 attached to the second end 44, or the opposing end to the end 42 to which the visible cap 70 is attached. The hidden cap 60 is attached to the second end 44 of the intermediate segment 24 and inner segment 26 for bearing a load between the attached segment (22, 24, 26) and the adjacent, external segment (22, 24, 26). The hidden cap 60 defines a foundation portion 64 abutting the second end 44 of the attached segment (22, 24, 26). The foundation portion 64 has an interior edge 68 extending along, or extending to, a cross-sectional contour of the outer wall 40 of the adjacent segment (22, 24) or of the inner wall 30 of the segment to which the hidden cap 60 is attached. In addition, the foundation portion may have an exterior edge 66 extending along, or extending to, a cross-sectional contour of the inner wall 30 of the adjacent, external segment (24, 26). Furthermore, the hidden portion 60 define a plurality of holes 69 superimposed over the screw bosses 38 for fasteners to extend therethrough. The hidden caps 60 also define a plurality of tabs 80 that extend along the outer wall 40 of the attached segment (22, 24, 26) in frictional engagement with the inner wall 30 of the adjacent, external segment (22, 24). Each of the tabs 87 extends along opposite sides of the corners of the first end 32 to accept the flanges 44 therebetween. Like the visible cap 70, the hidden cap 60 could comprise any material. In the illustrated examples, the leg 20 is for a table leg and the flanges 74 and tabs 80 are limited from approaching each other by about four inches or ten centimeters. Of course, for legs 20 with less overall extension or of different size, could get closer than the example above or stay further away, depending on the size, shape, length of extension, weight potentially applied and likely sideways force applied.

The visible caps 70 further include clips 76 extending therefrom in alignment with the extruded ribs 36. The extruded ribs 36 may include a notch 37 that the clip 76 fits within when assembled. The clips 76 include two legs 77 extending along an axial direction and a cross leg 78 extending between the two legs 77. The cross leg 78 is configured to fit within the notch 37. In the illustrated embodiment, the cross leg 78 and legs 78 generally extend flush or reversed relative to the extruded ribs 36. In assembly, the visible caps 70 are assembled and inserted into an end 42, 44 and the cross legs 75 slides along the extruded rib 36 until it snaps into the notch 37.

In one embodiment, for standard height work surface, an actuator is connected to the segments for moving each of the segments (22, 24, 26) until a minimum of four inches of overlay between segments (22, 24, 26), i.e., each of the segments (22, 24, 26) are disposed only four inches into the cavity of the adjacent, external segment (22, 24, 26). The actuator can be any type of actuator known in the art including but not limited to chain and gear, pinion gear, pneumatic, hydraulic, and screw and thread.

In operation, the actuator moves the segments (22, 24, 26) relative to one another ideally until there is a minimum of four inches of overlay between segments (22, 24, 26), i.e., each of the segments (22, 24, 26) are disposed only four inches into the cavity of the adjacent, external segment (22, 24, 26). In other words, the movement of the segments (22, 24, 26) in the preferred embodiment are limited to the length of the flanges 74 of the caps 70 and the length of the tabs 80 of the hidden caps 60 so that the tabs 80 and flanges 74 are always in contact with the adjacent segments (22, 24, 26). Ideally, the outer segment 22 sits on or is attached to a base or the floor or work surface while the inner segment 26 is attached to the work surface or base. As stated, outer segment 22 and the inner segment 26 can be reversed.

It is another aspect of this invention to provide a better method of assembling a telescopic leg 20. The first step involves forming the aforementioned segments (22, 24, 26). Forming can be accomplished by molding or any processes known in the art for developing shapes comprising homogenous and composite compositions. Another step involves forming a visible cap 70 that defines a face portion and plurality of flanges 74.

The visible cap 70 is then attached to a first end 42 of at least one of the segments (22, 24, 26). During this step, the plurality of flanges 74 are slid along the inner wall 30 of the segment (22, 24, 26) and the face portion is abutted against the first end 42. Ideally, the flanges 74 are formed to shape and disposed on the visible cap 70 to slide along the inset corners 100 of any intermediate segments 24 and the profiled corners 110 inner segment 26. Next, the flanges 74 may be greased to facilitate sliding against the outer wall 40 of the adjacent, internal segment (22, 24, 26). The step of attaching the cap 40 further includes pushing the engagement projections 72 into the screw bosses 38. However, it should also be appreciated that the visible cap 70 could also be attached to the first end 42 of the segment (22, 24, 26) by any other means, as a non-limiting example, by adhesive. As illustrated in the figures and discussed above, the cross leg 78 will snap into the notch 37 when assembled.

Subsequently, the segments (22, 24, 26) are assembled by aligning at least two of the segments (22, 24, 26) along an axis A sequentially by size. Next, the aligned segments (22, 24, 26) are compressed together until all of the ends (32, 34) are aligned and the base segment 22 surrounds the intermediate segment 24 and the intermediate segment 24 surrounds the top segment 26. During compression, the visible caps 70 are sheared with the edges 71' on one of the ends (42, 44) of the adjacent segments (22, 24, 26) as the first end 42 of one segment (22, 24, 26) enters the cavity of the adjacent segment (22, 24, 26). Specifically, this step of shearing the visible cap 70 includes shearing the visible cap 70 with both the adjacent, internal segment (22, 24, 26) and the adjacent, external segment (22, 24, 26). Likewise, during the step of compression the hidden cap 60 is sheared with edges on one of the ends (42, 44) of the adjacent segments (22, 24, 26) as the second end 44 of one segment (22, 24, 26) enters the cavity of the adjacent segment (22, 24, 26). Like the visible cap 70, the step of shearing the hidden cap 60 includes shearing the hidden cap 60 with the adjacent, internal segment (22, 24, 26) and the adjacent, external segment (22, 24, 26). Obviously, the visible caps 70 and the hidden caps 60 on the end segments (22, 26), in this case the outer segment 22 and the inner segment 26, would be sheared by the only adjacent intermediate segment 24. Importantly, the intermediate segments 24, which could be more than one, may be the only segments with both a visible cap 70 and a hidden cap 60.

A hidden cap 60 is formed that defines a foundation portion and a plurality of tabs 80 which are then also may be greased to facilitate sliding against the internal wall 28 of the adjacent, external segment (22, 24, 26). During the forming process each of the tabs 80 are formed so they can be superimposed on opposite sides of the corners to accept the flanges 74 therebetween. The hidden cap 60 is then connected to the other or second end 44 of at least one of the segments (22, 24, 26). The step of connecting the hidden cap to the segment (22, 24, 26) includes sliding the plurality of tabs 80 along the outer wall 40 of the segment (22, 24, 26) and abutting the foundation portion to the end 44. Next, the hidden cap 60 is screwed to the end 44 of the segments (22, 24, 26) through a plurality of holes 69 in the cap 60 and the screw bosses 38. As with the visible cap 70, the hidden cap 60 can also be attached to the first end 42 of the segment (22, 24, 26) by any other means, such as adhesive, or the cross leg 78 in combination with the notch 37.

Obviously, many modifications and variations of the present invention are possible in light of the above teachings and may be practiced otherwise than as specifically described while within the scope of the appended claims. These antecedent recitations should be interpreted to cover any combination in which the inventive novelty exercises its utility. The use of the word "said" in the apparatus claims refers to an antecedent that is a positive recitation meant to be included in the coverage of the claims whereas the word "the" precedes a word not meant to be included in the coverage of the claims. In addition, the reference numerals in the claims are merely for convenience and are not to be read in any way as limiting.

What is claimed is:

1. A telescopic leg comprising:

a first segment having an outer wall and an inner wall both extending along an axis between a first end and a second end and wherein said inner wall defines a first segment cavity;

a second segment having an outer wall and an inner wall both extending between a first end and a second end along said axis, and wherein a portion of said second segment is disposed in the first segment cavity;

a visible cap coupled to one of said first and second ends of said first segment, said visible cap having an inner edge defining an opening through which said second segment extends and wherein said visible cap includes flanges extending between said inner wall of said first segment and said inner wall of said second segment and wherein said flanges are in fixed engagement with said first segment and sliding engagement with said second segment;

a hidden cap coupled to one of said first and second ends of said second segment, and wherein said hidden cap is disposed within the first segment cavity and includes tabs extending between said outer wall of said second segment and said inner wall of said first segment and wherein said tabs are in fixed engagement with said second segment and in sliding relationship with said first segment.

2. The telescopic leg of claim 1 wherein said first segment is a polygon having at least three sides and at least three corners, and wherein said inner wall of said first segment at said corners of said first segment includes at least three corners and wherein said at least three corners include elongated cavities having a slot extending along their length and wherein said visible cap includes engagement projections in an interference fit with said cavity and wherein said flanges extend inwardly from said engagement projections, through said slot.

3. The telescopic leg of claim 2 wherein said second segment includes inset corners and wherein said flanges on said visible cap coupled to said first segment extend to and engage said inset corners on the outer surface of said second segment.

4. The telescopic leg of claim 3 further including a third segment fitting within said second segment, and wherein said second segment includes a second visible cap coupled to said second segment and wherein said third segment includes a second hidden cap coupled thereto.

5. The telescopic leg of claim 4 wherein said third segment includes at least three sides with profiled corners between each side and wherein said second visible cap includes flanges extending from and in sliding engagement with said profiled corners.

6. The telescopic leg of claim 5 wherein said first segment includes at least three corners, said second segment includes at least three inset corners, and said third segment includes at least three profiled corners, and wherein the cross section profile of said corners is different from the cross section profile of the inset corners and the profiled corners.

7. The telescopic leg of claim 6 wherein the cross sectional profile of the inset corners is different from the cross section profile of the profiled corners.

8. The telescopic leg of claim 4 wherein said first visible cap has flanges with a first cross sectional profile and said second visible cap has a second cross section profile and wherein said first and second cross sectional profiles do not match.

9. The telescopic leg of claim 1 wherein said visible cap further includes at least one clip and is coupled to said first segment has at least three sides, and wherein at least one of said at least three sides on said first segment has an extruded rib on the inner wall, and wherein said inner rib includes a notch and wherein said visible cap is coupled to said first segment with said clip fitting within said notch.

10. The telescopic leg of claim 9 wherein at least one clip has a cross leg fitting within said notch and wherein said clip is recessed relative to the surface of said extruded rib when located in said notch.

11. The telescopic leg of claim 1 wherein said hidden cap includes tabs extending between said first and second segment, and wherein said tabs are in sliding engagement with said first segment.

12. A method of assembling a telescopic leg having a first, second and third segments and wherein said first and second segments each include an inner surface having an extruded rib with a notch, and a first and second end, a first and second visible cap, each having engagement projections with flanges, clips and an opening with an inner edge, and a first and second hidden cap, each having flanges, said method including the steps of:

assembling a first visible cap to the first end of said first segment by inserting the first visible cap into an opening on the first end of the first segment until the clip on the first segment is located at least partially in said notch, and inserting the second visible cap into an opening on the first end of the second segment;

inserting the second end of the second segment through the visible cap into the opening on the visible cap on the first segment and wherein the opening on the visible cap is smaller than the second end of the second segment, and wherein during said step of inserting, the second end cuts a bigger opening on the first visible cap on the first segment; and inserting the second end of the third segment through the second visible cap into the opening on the second visible cap on the second segment and wherein the opening on the second visible cap is smaller than the second end of the third segment, and wherein during said step of inserting, the second end cuts a bigger opening on the second visible cap on the second segment.

13. The method of claim 12 further including the steps of assembling the hidden caps to the second ends of the second and third segments, after said steps of inserting.

14. The method of claim 13 wherein the shape of said opening on each of said visible caps does not match the shape of the second ends of the second and third segments until after said steps of inserting are completed.

* * * * *